US007841261B2

(12) United States Patent
Milligan et al.

(10) Patent No.: US 7,841,261 B2
(45) Date of Patent: Nov. 30, 2010

(54) REINFORCED IMPACT SOCKET

(75) Inventors: Kenneth R. Milligan, Uniontown, OH (US); Terry Taylor, Copley, OH (US); Gregory W. Helbling, Copley, OH (US); Wayne Snyder, Silverlake, OH (US)

(73) Assignee: Wright Tool Company, Barberton, OH (US)

( * ) Notice: Subject to any disclaimer, the term of this patent is extended or adjusted under 35 U.S.C. 154(b) by 0 days.

(21) Appl. No.: 11/899,834

(22) Filed: Sep. 7, 2007

(65) Prior Publication Data

US 2009/0064825 A1 Mar. 12, 2009

(51) Int. Cl.
*B25B 13/06* (2006.01)

(52) U.S. Cl. ..... 81/121.1

(58) Field of Classification Search ..... 81/121.1, 81/124.6, 900, 125

See application file for complete search history.

(56) References Cited

U.S. PATENT DOCUMENTS

| | | | | | |
|---|---|---|---|---|---|
| 2,788,690 | A * | 4/1957 | Able | 81/124.6 |
| 3,951,556 | A * | 4/1976 | Strizki | 403/2 |
| 4,014,417 | A * | 3/1977 | Kugler et al. | 191/29 DM |
| 4,040,770 | A * | 8/1977 | Carlson | 416/230 |
| 4,082,144 | A * | 4/1978 | Marquis | 166/250.17 |
| 4,145,939 | A * | 3/1979 | Garrison | 81/125 |
| 4,289,340 | A * | 9/1981 | Press et al. | 285/382.4 |
| 4,469,057 | A * | 9/1984 | Black | 123/90.54 |
| 4,786,271 | A * | 11/1988 | Menn | 464/140 |
| 5,495,659 | A * | 3/1996 | Beakes et al. | 29/736 |
| 5,630,264 | A * | 5/1997 | Tsuji | 29/234 |
| 5,819,606 | A * | 10/1998 | Arnold | 81/124.3 |
| 5,970,826 | A * | 10/1999 | Iwinski et al. | 81/124.6 |
| 6,029,547 | A * | 2/2000 | Eggert et al. | 81/124.6 |
| 6,067,702 | A * | 5/2000 | Clemenz et al. | 29/596 |
| 6,126,882 | A * | 10/2000 | Iwinski et al. | 264/261 |
| 6,374,709 | B1 * | 4/2002 | Vasichek et al. | 81/125 |
| 6,397,706 | B1 * | 6/2002 | Maznicki | 81/121.1 |
| 6,609,445 | B2 * | 8/2003 | Elmore | 81/124.2 |
| 6,962,098 | B2 * | 11/2005 | Eggert et al. | 81/124.6 |
| 2005/0169764 | A1 * | 8/2005 | Heyes et al. | 416/244 A |

* cited by examiner

*Primary Examiner*—David B Thomas
(74) *Attorney, Agent, or Firm*—D. Peter Hochberg; Sean F. Mellino; Daniel J. Smola

(57) ABSTRACT

The present invention is a lightweight impact socket having an aluminum or other light metal blank having a fastener end and a drive end. A high strength, heat-treated steel alloy insert is inserted into the fastener end of the blank and glued in place to yield a highly effective impact socket. A drive end insert can be inserted into the bore at the drive end to add strength to the drive end of the impact socket. A high strength, heat-treated steel alloy sleeve can be adhered to the outside of the lightweight blank to add further strength to the drive end of the impact socket.

14 Claims, 2 Drawing Sheets

REINFORCED IMPACT SOCKET

BACKGROUND OF THE INVENTION

1. Field of the Invention

This invention relates to impact sockets, and in particular to lightweight sockets such as extended length impact sockets.

2. Background of the Invention

Impact sockets are well known in the art. Impact sockets are rotated by impact wrenches, impact guns or guns. These guns are designed to deliver high torque output with minimum exertion by the user, by storing energy in rotating mass such as a hammer, and the sudden delivery of the energy to the output shaft. Guns use compressed air, hydraulics or electrical energy. Guns are used for precise output torque. Impact sockets can be used for every standard socket, wrench drive size, from small one quarter inch sizes to over three and one half inch sizes.

Impact sockets are traditionally made from high strength alloy steel. Steel is a particularly good material for impact sockets because it is able to absorb considerable energy without failure. The ability of a metal to absorb energy without fracture is known as "toughness." "Fracture toughness" is a measure of the stress required to propagate cracking in a material that contains microflaws such as grain boundaries and second phase particles or occlusions. Steel sockets are forged to achieve grain orientation in the material that gives the socket high fracture toughness when loaded. Type 4047 steel is often used in impact sockets. Other types of high strength alloy steel are Type 4140 and Type 4340.

One problem with steel is its relative heaviness when compared with lightweight metals such as aluminum. Lightweight impact sockets are much desired when used overhead, particularly with extended length impact sockets such as those sockets that are greater than 3½ inches in length. In one instance, a lightweight deep impact socket (a deep socket is used for turning a nut on a bolt, and the bolt extends into the socket) was made from aluminum. Each impact socket was made from 7075 aluminum, and the maker of the sockets was Fastorq Bolting Systems of Houston, Tex. They were turned by a Racine hydraulic impact gun, and also by a Fairmount hydraulic impact gun. The impact guns were listed as being capable of producing 500 foot-pounds torque. Four 7075 aluminum sockets were tested, and all failed. The characteristics of the four failed aluminum impact sockets were as follows:

| Size | Weight | Type of Failure |
|---|---|---|
| 1⅝ inch hex head | 1.56 lbs. | Split half way down the length from the drive end. |
| 1⅝ inch hex head | 1.55 lbs. | Fractured initiated in one corner of the opening for the square ¾ inch drive. |
| 1 15/16 inch square head | 1.86 lbs. | Incipient cracks in all four corners of the opening for the square ¾ inch drive. |
| 1½ inch hex head | 1.51 lbs. | Cracks originated in three of the four corners of the opening for the square ¾ inch drive. |

The 7075 aluminum alloy used for the four preceding aluminum impact sockets is the highest strength aluminum in the aluminum family. The 4047 steel is 2.8 times heavier than the 7075 aluminum, but the 4047 steel is far greater than 2.8 times resistant to breakage when impact loaded. Material strength properties vary with the speed of load application. An important difference between static and impact loading is that statically loaded sockets must be designed to carry loads, whereas impact sockets must be designed to absorb energy. Steel such as 4047 steel has the requisite toughness and fracture toughness. The aluminum impact sockets are machined, not forged, and have poor fracture toughness properties when loaded in torsion as the multiaxial stress state induced imposes simultaneous elastic and plastic deformation in the material. When torque is applied in the area of the drive stem, the material is not uniformly loaded across its load bearing cross section. Therefore, it is likely that the 7075 aluminum impact socket will develop cracks and fail no matter how thick and beefy it is made. An impact socket must be able to withstand wear, and 7075 aluminum has extremely poor wear resistant properties compared to 4047 heat-treated steel.

SUMMARY OF THE INVENTION

An object of the present invention is to provide a lightweight impact socket capable of long life under normal operating conditions.

Another object is to provide an extended length lightweight impact socket capable of long life under normal operating conditions.

It is a further object to provide a lightweight impact socket for overhead use which is capable of having a long life under heavy duty work load.

It is yet another object to provide a lightweight impact socket having high wear resistant properties when compared with high strength aluminum impact sockets.

Still yet a further object of the present invention is to provide a lightweight impact socket capable of sustained repeated loading at 500 foot-pounds torque.

Another object is to provide a lightweight socket to be driven various powered tools and manual tools.

According to the preferred embodiment of the invention, an aluminum extended length impact socket blank was fitted with a high strength, heat-treated alloy steel insert at the fastener or socket end of the impact socket blank, and with a high strength, heat-treated alloy steel insert at the drive end of the impact socket blank; a high strength, heat-treated alloy steel sleeve was adhered to the drive end of the blank to add further strength and toughness to the drive end. The inserts were all held in place by glue, and the sleeve was press fit onto the aluminum blank.

DETAILED DESCRIPTION OF THE PREFERRED EMBODIMENTS

The preferred embodiment of the present invention was prepared after the almost immediate failure of the extended length, deep impact sockets made from 7075 aluminum which were used on hydraulic guns listed as generating 500 foot-pounds torque. The inventor glued with an appropriate adhesive, a socket insert made from high strength, heat-treated alloy steel into the socket end of a 7075 aluminum steel blank. The blank had an enlarged socket end, and the socket insert had the desired size for the nut or bolt to be turned. A high strength, heat-treated alloy steel sleeve was press fit onto the drive end of the aluminum blank, and a high strength, heat-treated alloy steel insert with a square axial orifice was glued to the drive end of the aluminum blank to provide a square fitting for the hydraulic gun. The aluminum blank was dimensioned so that the latter steel sleeve and insert have the proper dimensions to be driven by the gun. Extended test on the foregoing prototype yielded no failures.

Figure 2:
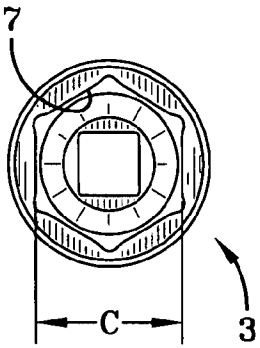
FIG. 2 is an end view of the fastener end of the aluminum impact socket blank shown in FIG. 1.
Figure 1:
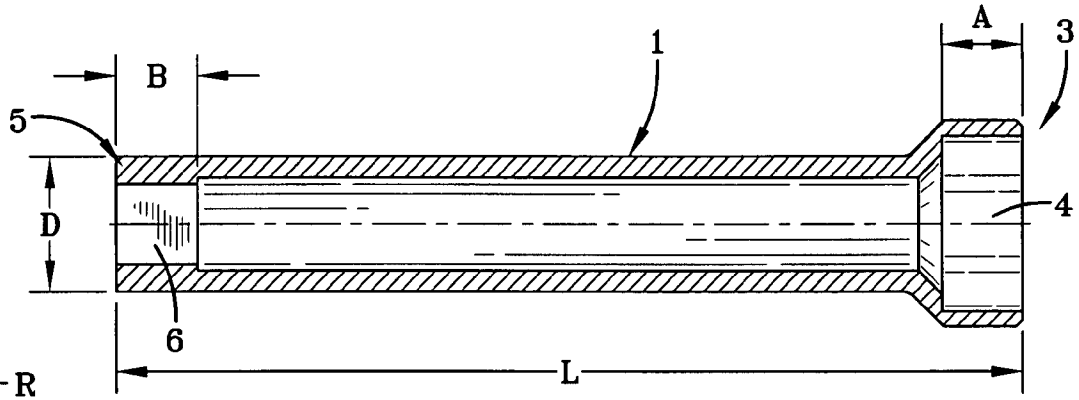
FIG. 1 is a lengthwise cross section of an aluminum impact socket blank.
Figure 3:
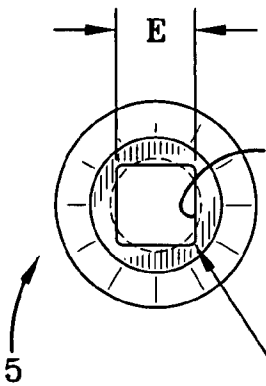
FIG. 3 is an end view of the drive end of the aluminum impact socket blank shown in FIG. 1.
Figure 7:
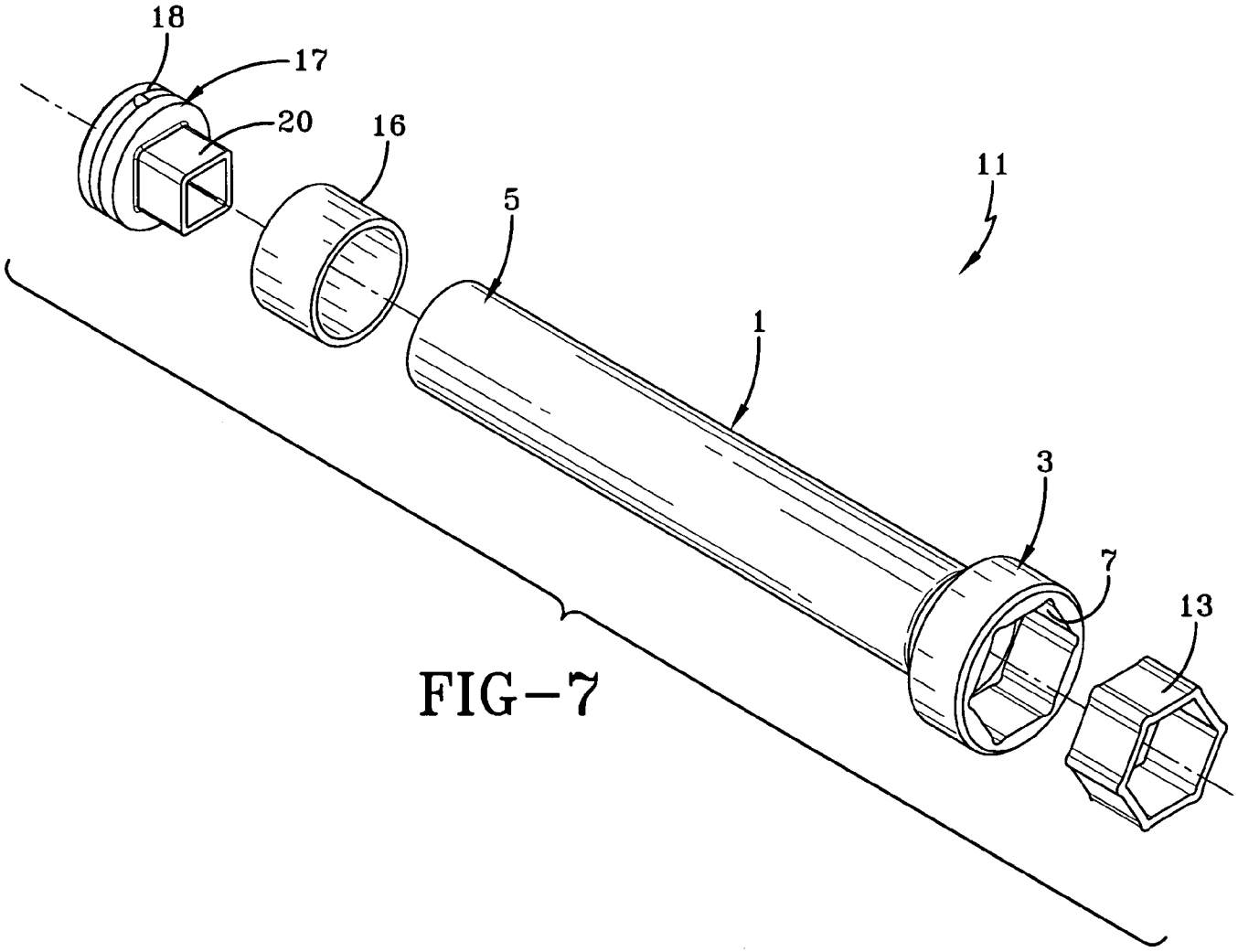
FIG. 7 is an exploded view of the impact socket shown in FIG. 4.

Turning first to FIGS. 1-3, an aluminum blank 1 is shown. Aluminum blank 1 is preferably made from 7075 aluminum for its high strength compared to other aluminum alloys and low weight compared to steel. Blank 1 has a fastener end 3 and a drive end 5. Fastener end 3 has a central bore 4, and drive end 5 has a central bore 6. Aluminum blank 1 has a length L, a socket end length A and a drive end length B. In one example of an extended length impact socket where L equals 12 inches, fastener end length A was 1.005 to 1.015 inches, and drive end length B was 1.015 to 1.025 inches. The hexagonal or hex socket cross dimension C was 1.810 to 1.812 inches. The outside diameter D of aluminum blank 1 at drive end 5 was 1.626 inches.

Fastener end 3 has a hex configuration 7. Drive end 5 has a square fitting 9 whose corners are rounded by a circle having a radius R. For the 12 inch socket length for aluminum blank 1, R equals 0.125 inches. The side dimension of square fitting 9 for the latter 12 inch blank 1 was 0.999 to 1.000 inches. Aluminum blank 1 can be manufactured in various ways such as machining, but for a commercial product extrusion would be the most economical.

Figure 5:
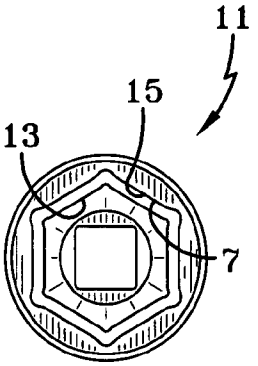
FIG. 5 is an end view of the fastener end of an impact socket as shown in FIG. 4.
Figure 4:
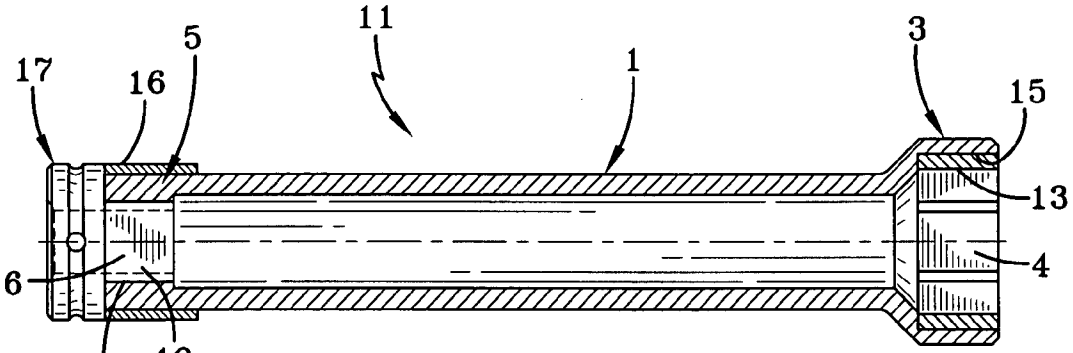
FIG. 4 is a lengthwise cross section of an impact socket according to the present invention.
Figure 6:
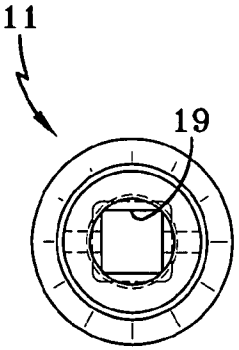
FIG. 6 is an end view of the drive end of the impact socket shown in FIG. 4.

A completed impact socket 11 according to the invention is shown in FIGS. 4-6. Impact socket 11 comprises aluminum blank 1 with fastener end 3 and drive end 5. Fastener end 3 has a high strength, heat-treated steel alloy hexagonal insert 13 inserted into the socket configuration 7 and held in place by a glue coating 15 since hex socket has transverse edges, hexagonal insert 13 cannot rotate, so that the glue or adhesive need not be extremely strong and would be required to prevent axial movement of steel alloy hexagonal insert 13, as well as to hold it fast against any possible minimal rotational movement. Hexagonal insert 13 has all of the qualities of a high strength steel alloy used in regular impact sockets. These qualities enable the steel insert to absorb considerable energy without failure. The steel insert has a much higher toughness and fracture toughness than does aluminum. A high strength alloy steel sleeve 16 is adhered by being press fit to the outer surface of drive end 5 of aluminum blank 1. A high strength, heat-treated alloy steel drive end insert 17 is inserted into the bore 6 in drive end 5 of aluminum blank 1 and held in place by an adhesive. Drive end insert 17 includes an outer portion 18 protruding beyond aluminum blank 1 and abutting drive end 5. Drive end insert 17 also includes an inner portion 20 for being inserted into drive end 5 of blank 1. Drive end insert 17 has a square fitting 19 to be engaged by the ratchet square or tang of the gun being used to rotate impact socket 11. The gun in the present instance was a hydraulic driven gun, but it could be the more common compressed air gun or an electrically powered gun. The dimensions of aluminum blank 1 were such that drive end insert 17 provided the final desired dimensions to be operated by the gun, having the desired square fitting 19. The glue or adhesive 15 for drive end insert 17 can preferably be the same glue or adhesive as used to secure socket insert 13 in place. An appropriate adhesive was Loctite 331 Speed Bonder with a Loctite 7387 activator. Other adhesives including epoxies should all function well. Sleeve 16 is provided both to add strength to the drive end of impact socket 11 and to supplement the strength and toughness of drive end insert 17.

The steel insert of the socket of the aluminum blank, as well as insert for the drive end and pressed-on sleeve, are heat treated as are conventional impact sockets. The heat treatment is conducted after the respective parts are machined to change the physical properties of the steel, after which the heated steel parts are quenched in oil to improve their strength, but also making them brittle. The parts are then tempered at specified temperatures to reduce the brittle characteristics. The inserts can be manually inserted.

The steel insert at the fastener end, the steel insert at the drive end, the steel sleeve on the outside surface of the drive end provide excellent devices for heavy duty use. Heavy duty means at least ½ inch driving square for fairly consistent use. Long life in many instances means years of use, although in some applications such as using impact sockets according to the invention would be a year or so.

The present invention has yielded an extremely useful lightweight impact socket for use where such lightweight impact sockets are desirable. The impact socket according to the invention was tested and showed far superior results to the aluminum impact socket which failed almost immediately upon testing. The impact socket according to the invention was an extended length impact socket which underwent about 20,000 loadings with a 500 foot-pounds impact load without failure. The weight increase with the high strength, heat-treated steel alloy was minimal, yet turned out an extremely useful tool which would be expected to last as long as a high strength, heat-treated steel alloy impact socket. Steel extended length impact sockets usually the ratchet or tang of an impact gun have a square side of ½ inch or more, and can weigh 4½ pounds or more, whereas a corresponding impact socket of the present invention would weigh around 2 pounds. The cost of the glue or adhesive is generally insignificant, and the cost of inserting the socket end insert, the drive end insert and can be done manually with minimal training. Steel sleeves according to the invention are preferably press fit onto the blank, and the press fit both holds the sleeve in place and strengthens the drive end. The invention can also be used with sockets turned by powered ratcheting tools and by manually operated tools as well, for particular use in overhead places such as substations and mines.

Impact sockets (and regular sockets) according to the present invention find particular advantage in overhead use. Such overhead use includes use by linesmen, including those on repair trucks for turning nuts and bolts above a work station, use in mines for assembling overhead support structure and building construction.

The invention has been described in detail with particular emphasis on the preferred embodiment, but variation and modifications may occur to those skilled in the art to which the invention pertains.

We claim:

1. A low weight impact socket comprising:

an aluminum socket blank having a socket end and a drive end, the socket end having an interior configuration with a polygonal cross section;

a socket insert made from high strength steel alloy inserted into the socket end of said aluminum socket blank, said socket insert having an exterior configuration being generally the same configuration as the interior configuration of said socket end being slightly smaller than said socket end, said socket insert cooperating with the inside of said socket end of said aluminum socket blank, said socket insert having a predetermined interior configuration and dimensions for engaging particular sized nuts or bolts; and a high strength steel alloy drive end insert operatively connected to the drive end of said aluminum socket blank, said drive end insert comprising:

an inner drive end portion for being inserted into the drive end of said blank; and an outer drive end portion for protruding beyond the drive end of the socket blank for providing a high strength fitting for a gun to be used to rotate said impact socket.

2. A low weight impact socket according to claim 1 and further comprising an adhesive disposed between the exterior of said socket insert and the interior of said socket end for securing said socket insert to the socket end of said aluminum socket blank.

3. A low weight impact socket according to claim 1 and further including a high strength steel alloy sleeve operatively connected to the outer surface of said drive end of said blank, said sleeve having a length coextensive with the inner drive end portion of said drive end insert inserted into the drive end of said blank.

4. A low weight impact socket according to claim 3 wherein said sleeve is press fit onto the outer surface of said drive end of said blank.

5. A low weight impact socket according to claim 1 wherein said high strength steel alloy drive end insert further comprises a hollow square fitting to be engaged by the ratchet square or tang of the gun being used to rotate said impact socket.

6. A low weight impact socket according to claim 5 and further including an adhesive for adhering said drive end insert to the drive end of said blank.

7. A low weight impact socket according to claim 1 wherein said exterior configuration of said socket insert and said interior configuration of said socket end each have generally hexagonal cross sections.

8. A low weight impact socket according to claim 1 and further including a securing feature for engaging said socket blank and said socket insert for preventing rotation of said socket insert relative to said socket blank and for preventing axial movement of said socket insert relative to said socket blank when said impact socket is applying a turning force to a nut or bolt.

9. A low weight impact socket according to claim 1 having a weight of approximately 2 pounds and capable of withstanding about 20,000 loadings with a 500 foot-pounds impact load without failure.

10. A lightweight socket for being turned by power-operated ratcheting tools or manual tools, said socket comprising:

an aluminum socket blank having a fastener end with an interior configuration and a drive end;

a socket insert made from high strength steel alloy and having an exterior configuration, said socket insert being inserted into and operatively connected to the fastener end of said socket blank with the interior configuration of said fastener end cooperating with the exterior configuration of said insert to prevent rotation of said socket insert relative to said socket blank;

a high strength steel alloy drive end insert operatively connected to the drive end of said aluminum socket blank, said drive end insert comprising:

an inner drive end portion for being inserted into the drive end of said blank; and an outer drive end portion for protruding beyond the drive end of the socket blank for providing a high strength fitting for a hand tool to be used to rotate said socket; and a sleeve made from high strength steel alloy having a length generally equal to the length of said inner drive end portion and operatively connected to the outer surface of said drive end.

11. A low weight impact socket according to claim 10 wherein said exterior configuration of said socket insert and said interior configuration of said socket end each have hexagonal cross sections.

12. A low weight impact socket for being turned by power-operated ratcheting tools or manual tools, said power-operated ratcheting tools or manual tools having a male drive end having an exterior configuration, said low weight impact socket comprising:

a female drive end having an interior configuration matching said exterior configuration of said male drive end of said power-operated ratcheting tools or manual tools;

a socket end having an interior configuration with a generally polygonal cross section;

an aluminum blank connecting said female drive end and said socket end;

a socket insert made from high strength steel alloy inserted into the socket end of said aluminum blank, said socket insert having an exterior configuration being generally the same configuration as the interior configuration of said socket end and being slightly smaller than said socket end, said socket insert cooperating with the inside of said socket end of said impact socket, said socket insert having a predetermined interior configuration and dimensions for engaging particular sized nuts or bolts; and a high strength steel alloy drive end insert operatively connected to the drive end of said aluminum socket blank, said drive end insert comprising:

an inner drive end portion for being inserted into the drive end of said blank; and an outer drive end portion for protruding beyond the drive end of the socket blank for providing a high strength fitting for a hand tool to be used to rotate said socket.

13. A low weight impact socket according to claim 12 and further including a securing feature for engaging said socket blank and said socket insert for preventing rotation of said socket insert relative to said socket blank and for preventing axial movement of said socket insert relative to said socket blank when said impact socket is applying a turning force to a nut or bolt.

14. A low weight impact socket comprising:

an aluminum socket blank having a socket end and a drive end, the socket end having an interior configuration with a generally polygonal cross section with rounded corners in place of sharp angles which would exist for true polygons;

a socket insert made from high strength steel alloy inserted into the socket end of said aluminum socket blank, said socket insert having an exterior configuration being generally the same configuration as the interior configuration of said socket end being slightly smaller than said socket end, said socket insert cooperating with the inside of said socket end of said aluminum socket blank, said socket insert having a predetermined interior configuration and dimensions for engaging particular sized nuts or bolts; and a high strength steel alloy drive end insert operatively connected to the drive end of said aluminum socket blank, said drive end insert comprising:

an inner drive end portion for being inserted into the drive end of said blank; and an outer drive end portion for protruding beyond the drive end of the socket blank for providing a high strength fitting for a hand tool to be used to rotate said socket.

* * * * *